US010118806B2

(12) United States Patent
Leicester

(10) Patent No.: US 10,118,806 B2
(45) Date of Patent: Nov. 6, 2018

(54) STABILISER

(71) Applicant: Gordon Charles Leicester, Hickstead (GB)

(72) Inventor: Gordon Charles Leicester, Hickstead (GB)

( * ) Notice: Subject to any disclaimer, the term of this patent is extended or adjusted under 35 U.S.C. 154(b) by 0 days.

(21) Appl. No.: 15/527,646

(22) PCT Filed: Nov. 17, 2015

(86) PCT No.: PCT/GB2015/053476
§ 371 (c)(1),
(2) Date: May 17, 2017

(87) PCT Pub. No.: WO2016/079489
PCT Pub. Date: May 26, 2016

(65) Prior Publication Data
US 2017/0327354 A1 Nov. 16, 2017

(30) Foreign Application Priority Data
Nov. 18, 2014 (GB) ..... 1420485.3

(51) Int. Cl.
*B66C 23/78* (2006.01)
*E02F 9/08* (2006.01)

(52) U.S. Cl.
CPC ..... *B66C 23/78* (2013.01); *E02F 9/085* (2013.01)

(58) Field of Classification Search
CPC . B66C 23/78; B66C 23/80; B66F 3/38; B66F 2700/0378; E02F 9/085; E04H 12/2238; E04H 12/24; B60S 9/00; B60S 9/12; B60S 9/02
See application file for complete search history.

(56) References Cited

U.S. PATENT DOCUMENTS 2,308,157 A * 1/1943 Cuthrell ..... B66C 23/78 280/27
4,013,308 A * 3/1977 Paul ..... E02F 9/085 248/357
4,014,519 A 3/1977 Leigh
(Continued)

FOREIGN PATENT DOCUMENTS

CN 102838046 A * 12/2012 ..... B66C 23/78
CN 202 703 546 U 1/2013
(Continued)

OTHER PUBLICATIONS

PCT/GB2015/053476, International Search Report and Written Opinion, dated Feb. 17, 2016.
(Continued)

*Primary Examiner* — James A Shriver, II
*Assistant Examiner* — Steve Clemmons
(74) *Attorney, Agent, or Firm* — Fay Sharpe LLP

(57) ABSTRACT

Mobile plant stabilizer (2) including an extendible leg (4) and a load distributing foot (12) connected to the extendible leg (4), wherein the foot (12) includes a primary part (14) and an extension part (18) connected to the primary part (14) by a hinge (20) enabling the extension part (18) to rotate relative to the primary part (14) to and from a deployed position in which the extension part (18) extends laterally outwardly from the primary part (14).

15 Claims, 9 Drawing Sheets

(56) References Cited

U.S. PATENT DOCUMENTS

| | | | | | |
|---|---|---|---|---|---|
| 4,266,809 | A * | 5/1981 | Wuerflein | B66C 23/78 | 248/677 |
| 4,824,136 | A * | 4/1989 | Baxter | B60S 9/04 | 16/42 T |
| 5,899,496 | A * | 5/1999 | Muraro | E02F 9/085 | 280/765.1 |
| 7,128,340 | B1 * | 10/2006 | Alguera Gallego | B60S 9/02 | 280/763.1 |
| 7,395,993 | B2 * | 7/2008 | Riedl | B60S 9/04 | 248/188.2 |
| 2004/0046378 | A1 * | 3/2004 | Lagsdin | B60S 9/02 | 280/766.1 |
| 2014/0001739 | A1 * | 1/2014 | Rutherford | B60S 9/12 | 280/766.1 |
| 2016/0340156 | A1 * | 11/2016 | Ost | B66C 23/78 | |

FOREIGN PATENT DOCUMENTS

| | | | | | |
|---|---|---|---|---|---|
| CN | 103 112 788 | A | | 5/2013 | |
| DE | 3339863 | A1 | * | 6/1984 | B66C 23/78 |
| JP | 58174052 | A | * | 10/1983 | |
| JP | H 08-2883 | A | | 9/1996 | |
| JP | 2002 127879 | A | | 5/2002 | |
| JP | 2011 168148 | A | | 9/2011 | |
| SU | 1265132 | A1 | | 10/1986 | |
| WO | WO-2016023601 | A1 | * | 2/2016 | B66C 13/46 |

OTHER PUBLICATIONS

GB 1420485.2, Search Report Under Section 17, dated May 18, 2015.

* cited by examiner

FIG.14
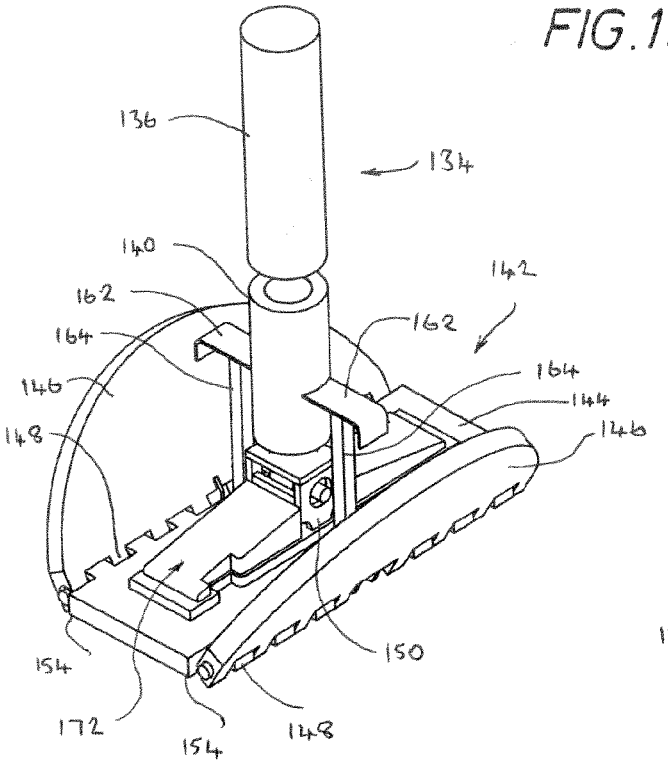
FIG.15
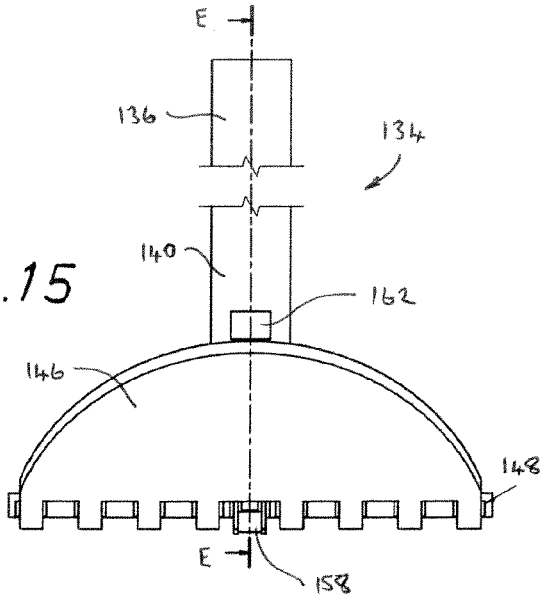
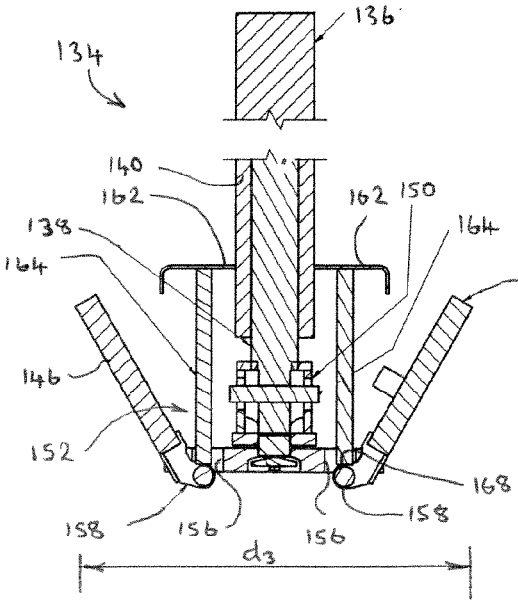
FIG.16

STABILISER

The present invention relates to a mobile plant stabiliser of the type typically used to stabilise a mobile crane or lorry with a loading and unloading jib.

Items of mobile plant, such as those referred to above, are customarily provided with downwardly and also possibly outwardly deployable stabiliser legs. When moving the plant it is important for the legs and associated feet to project outwardly to a minimum extent and for this reason the feet provided on such stabiliser legs often have an undesirably small lateral extent. One major drawback of such small feet is that, for certain support surfaces such as soft ground or raised flooring, the area of the feet is insufficient. In such circumstances it is necessary to provide load spreading members underneath the feet, the positioning of which can be an awkward task for a sole operator of an item of plant since it may involve moving back and forth between stabiliser leg deployment controls and the leg itself. Furthermore, it is inconvenient to have to transport and store such load spreading members. Also, because of the loads concerned, the weight of such load spreading members is often close to the maximum load that an operator can be expected to handle.

As a consequence of the matters explained above, it is not uncommon for inadequate load spreading to be provided which can result in dangerous canting of the plant when under load and also damage to flooring.

An object of the invention is to alleviate at least one of the above problems.

According to the invention there is provided a mobile plant stabiliser including an extendible leg and a load distributing foot connected to the extendible leg, wherein the foot includes a primary part and an extension part connected to the primary part by a hinge enabling the extension part to rotate relative to the primary part to and from a deployed position in which the extension part extends laterally outwardly from the primary part. The provision of such a stabilising leg on a mobile item of plant will avoid the inconvenience of storing individual load spreading means separately and handling them into position as the stabiliser is lowered onto a supporting surface. This will reduce the possibility of inadequate load spreading being provided for the stabiliser and significantly reduce the chance of the plant being operated in a manner which might lead to it toppling over, becoming unstable or damaging a support surface.

Preferably in its deployed position, a downwardly facing sole portion of the extension part forms an extension of a downwardly facing sole portion of the primary part.

In order to provide even support on opposite sides of the leg and to significantly increase the area of a support surface on which the foot bears, while allowing the foot to take up little room when not deployed, preferably the foot includes two extension parts arranged on opposite sides of the primary part and each connected to the primary part by a respective hinge.

So that separate means do not need to be provided to secure the or each extension part in place when the mobile item of plant is in transit, the stabiliser preferably includes retention means for holding the or each extension part in a non-deployed position.

Conveniently the retention means is configured to hold the or each extension part in its non-deployed position when the leg is retracted.

Preferably the retention means includes at least one retention member and wherein the or each extension part is engageable with one said retention member when the leg is in a retracted state to hold the extension part in its non-deployed position. With such an arrangement retention can be arranged to occur automatically as a result of retraction of the leg.

So that an operator does not need to go to a leg to release the or each extension part as the leg is extended, preferably the stabiliser is configured such that extension of the leg disengages the or each extension part from its associated retention member.

The or each extension part may include an abutment arranged such that retraction of the leg brings the abutment into contact with one said retention member thereby urging the extension part into its non-deployed position. With such an arrangement an operator would not need to go to a leg when it is being retracted in order to move the or each extension part to its non-deployed position So that separate means do not have to be provided so as to hold the or each extension part in its deployed position preferably the stabiliser includes a locking mechanism for locking the or each extension part in its deployed position.

Preferably the locking mechanism includes a locking member extending radially outwardly from the leg, one of the foot and the locking member being rotatable relative to the other about a longitudinal axis of the leg such that the or each extension part becomes engaged by the locking member to lock it in its deployed position. Such an arrangement permits easy actuation of the locking mechanism and provides secure locking of the or each extension part in its deployed position. Most conveniently the foot is rotatable with respect to the locking member. The foot will generally have a larger radial extent than the locking member and will therefore be easier to grasp and turn in order to actuate the locking mechanism.

In order to avoid the necessity of an operator having to go to a stabiliser when it is being deployed, preferably the stabiliser includes a deployment mechanism interconnecting the leg to the foot and configured to move the or each extension part into its deployed position when the leg is extended. Such moving preferably occurs as a result of extension of the leg. Conveniently the deployment mechanism is configured to move the or each extension part into its deployed position as a consequence of urging the primary part of the foot into engagement with a foot supporting surface.

Preferably the leg includes a lowerable portion and the deployment mechanism includes a foot support member which is longitudinally displaceable parallel to a longitudinal axis of the lowerable portion of the leg and a link member which interconnects the or each extension part and the lowerable portion of the leg. This arrangement provides a deployment mechanism with few parts which can serve the dual purpose of firstly effectively moving the or each extension part into its deployed position and secondly serving to lock the or each extension part in its deployed position.

In order to provide a balanced force on the leg, preferably the foot includes two extension parts and the deployment mechanism includes one said link member interconnecting each extension part and the lowerable portion of the leg.

Preferably the stabiliser includes biasing means which urges the foot support member so as to extend from the lowerable portion of the leg whereby each extension part is urged away from its deployed position. With such an arrangement lifting the foot away from a supporting surface will automatically result in the or each extension part being moved away from its deployed position. This will mean that an operator does not need to go to a stabiliser when it is being stowed away to manually move the or each extension part to its non-deployed position. The biasing means preferably comprises a compression spring.

In order to provide a system for warning an operator if the stabiliser is not fully deployed and/or stowed away the stabiliser preferably includes at least one proximity sensor for sensing a predetermined stage in a deployment sequence of the stabiliser. A proximity or other type of sensor may be provided to sense one or more of the following: full deployment; actuation of the locking means; rotation of the foot relative to the locking member such that the locking member locks the or each extension part in its deployed position; full stowage; and engagement of one extension part with its associated retention means.

The invention will now be described by way of example only with reference to the accompanying drawings in which:

FIG. 14 is a schematic perspective view of a third embodiment of a stabiliser according to the invention in its non-deployed or stowed configuration;

FIG. 15 is a side view of the stabiliser shown in FIG. 14 in its non-deployed configuration;

FIG. 16 is a schematic cross-section on the line E-E of the non-deployed stabiliser shown in FIG. 15;

A stabiliser 2 according to a first embodiment of the invention, shown in FIGS. 1 to 8, is described below.

Figure 4:
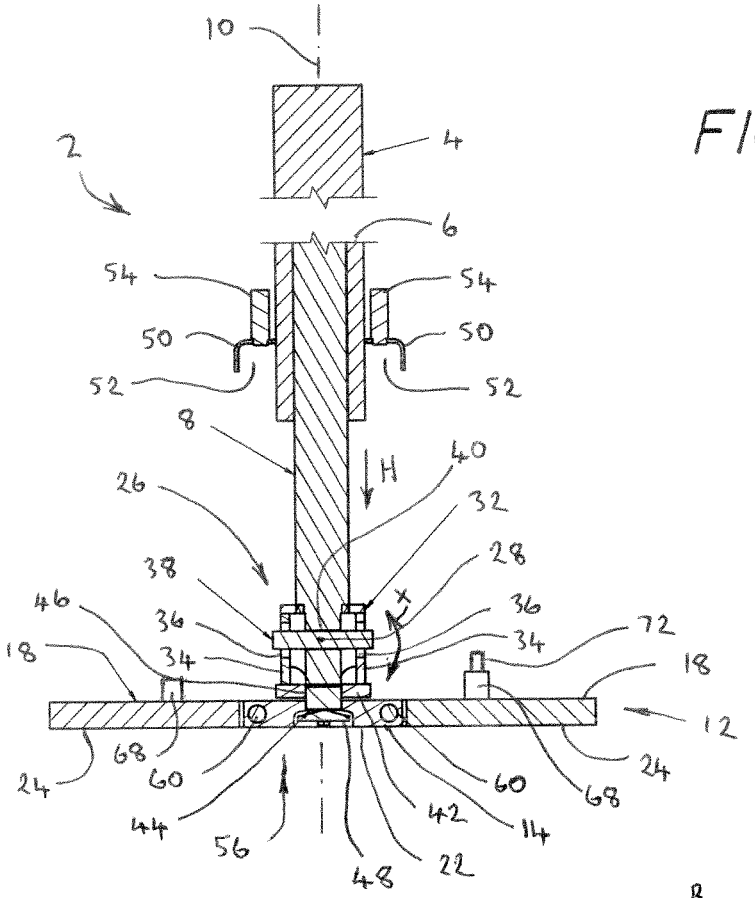
FIG. 4 is a schematic cross-section on the line B-B of the partially deployed stabiliser shown in FIG. 3.
Figure 5:
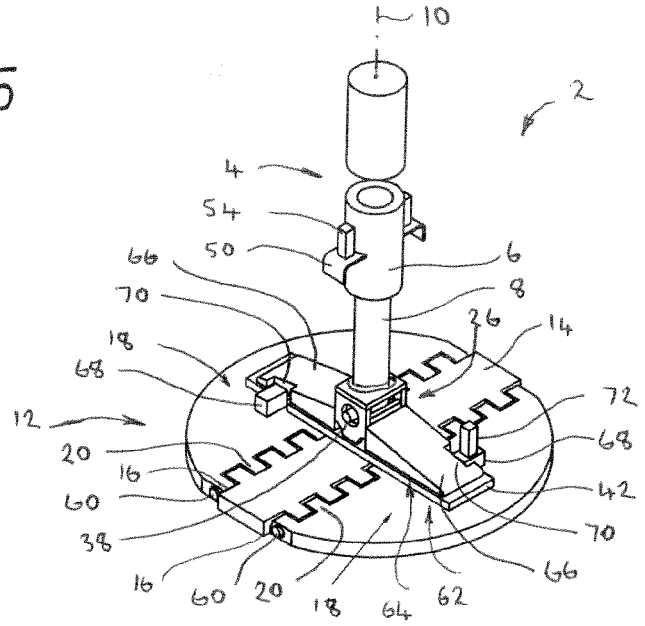
FIG. 5 is a schematic perspective view of the stabiliser shown in FIG. 1 in its fully deployed configuration.

As shown in FIG. 5, the stabiliser 2 includes an extendible leg 4. The extendible leg 4 includes a cylinder 6 or upper part and a ram or lower part 8. The ram 8 is extendible and retractable relative to the cylinder 6 along a longitudinal axis 10 of the extendible leg 4. Connected to a lower distal end of the extendible leg 4 is a foot 12. The foot 12 includes a primary part 14. Opposed sides 16 of the primary part 14 are each connected to an extension part 18 by means of a hinge 20. Each hinge 20 includes a hinge pin 60 which extends through interdigitated extensions of the primary part 14 and the respective extension part 18. The hinges 20 shown in the Figs. extend the entire length of each side 16 but need not do so. Each extension part 18 can rotate about its respective hinge between a stowed position shown in FIGS. 1 and 2 and a deployed or lowered position as shown in FIGS. 3 and 4.

Figure 6:
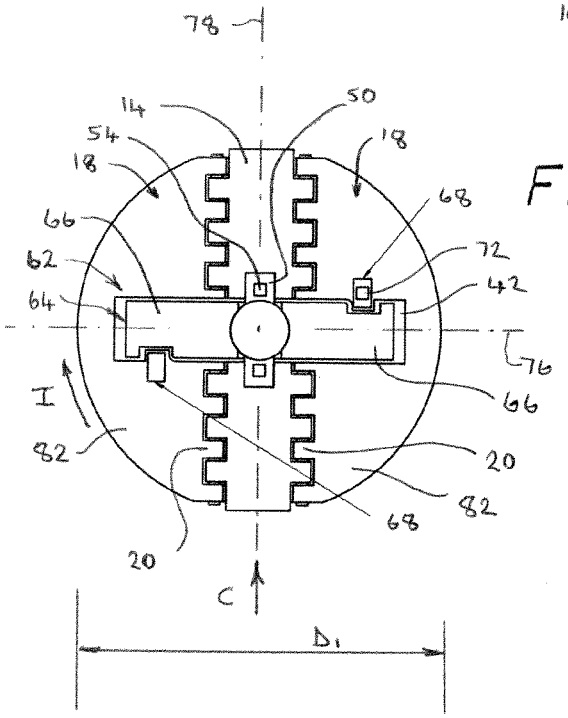
FIG. 6 is a schematic view from above of the stabiliser shown in FIG. 5.
Figure 7:
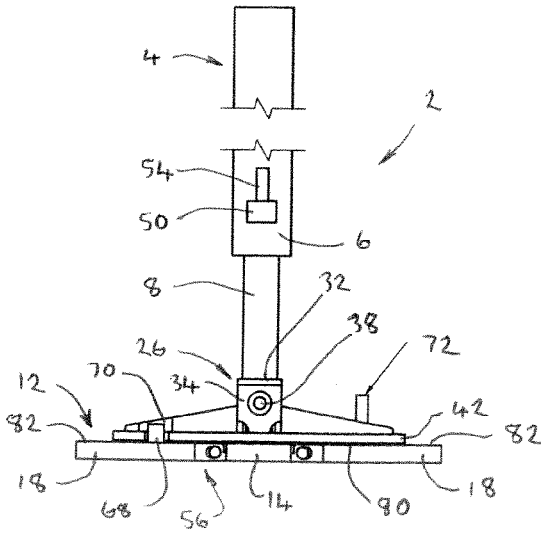
FIG. 7 is a schematic side view from the direction C of the stabiliser shown in FIG. 6 in its fully deployed configuration.

Downwardly facing sole portions 24 of the two extension parts 18 constitute extensions of a downwardly facing sole portion 22 of the primary part 14 when the extension parts 18 are in their deployed positions and when the stabiliser is in its fully deployed configuration shown in FIGS. 5, 6 and 7. The sole portions 22 and 24 are configured for engaging a load supporting surface 58 such as a floor or the ground.

Figure 8:
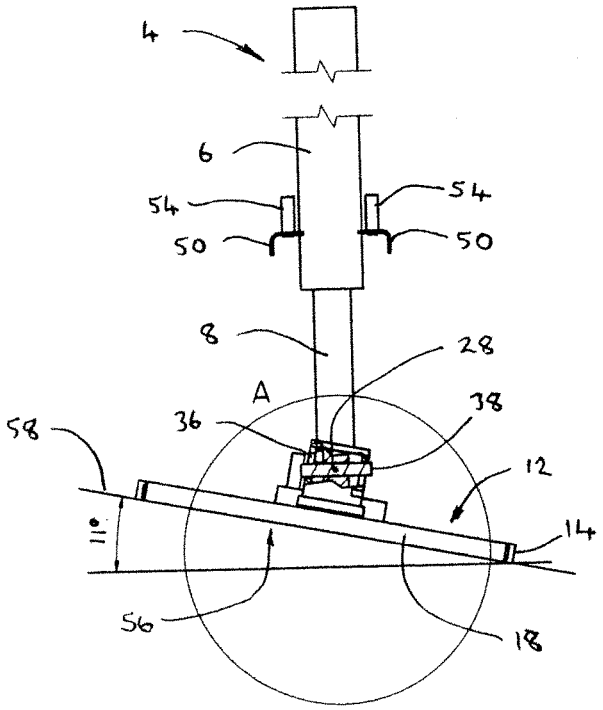
FIG. 8 is a schematic side view of the stabiliser shown in FIG. 5 engaging a sloping support surface.
Figure 9:
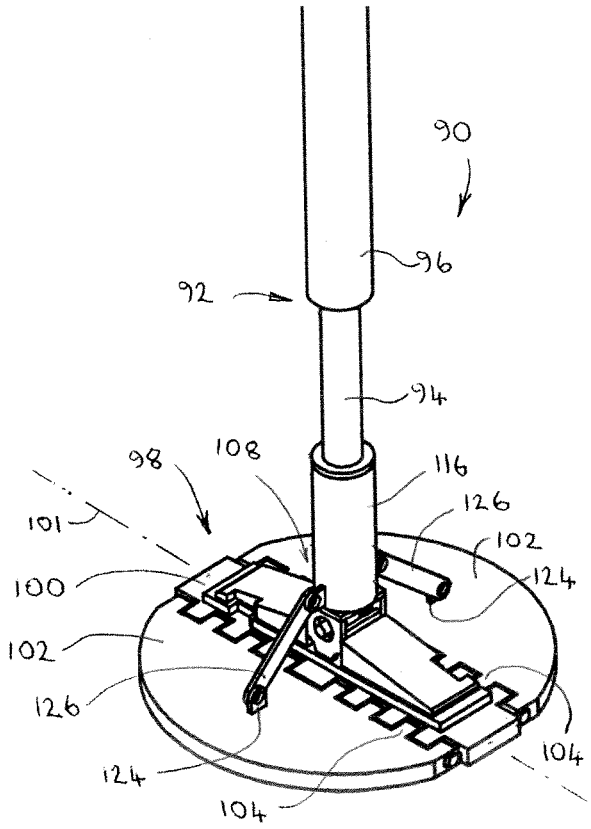
FIG. 9 is a schematic perspective view of a second embodiment of a stabiliser according to the invention in its fully deployed configuration.

The foot 12 is connected to a lower or distal end of the ram 8 by a foot mount 26. The foot mount 26 is configured to allow the foot 12 to rotate in a direction X about a first rotation axis 28 as shown in FIGS. 4 and 8. It is also configured to allow the foot 12 to rotate in the direction Y about a second rotation axis 30 as shown in FIG. 3. The axes 28 and 30 are substantially perpendicular to each other. Rotation of the foot 12 about the two axes 28 and 30 allows the foot to adopt a position in which a sole 56 of the foot 12, comprising sole portions 22 and 24, is not perpendicular to the longitudinal axis 10 of the extendible leg 4. This is useful when the foot is supported by a support surface 58 that is not horizontal. Rotation of the foot 12 by 22 degrees is possible about each rotation axis 28 and 30, thereby allowing the stabiliser to be used on support surfaces 58 disposed up to 11° from the horizontal. The foot mount 12 includes a box 32 with opposed side walls 34. Each side wall 34 has an aperture 36. A pivot pin 38, which extends through a hole 40, adjacent a distal end of the ram 8, extends through the apertures 36 in the two side walls 34. Clearance between the pivot pin 38 and the apertures 36 permits rotation of the box 32 in the direction X about the first rotation axis 28. A base plate 42 is connected to a lower end of the box 32 and has a stub shaft 44 projecting downwardly therefrom. The stub shaft 44 extends through a hole 46 in the primary foot part 14. A nut 48 is screwed onto the stub shaft 44 to hold the primary foot part 14 connected to the foot mount 26 such that it can rotate relative to the foot mount 26 about the longitudinal axis 10.

Figure 1:
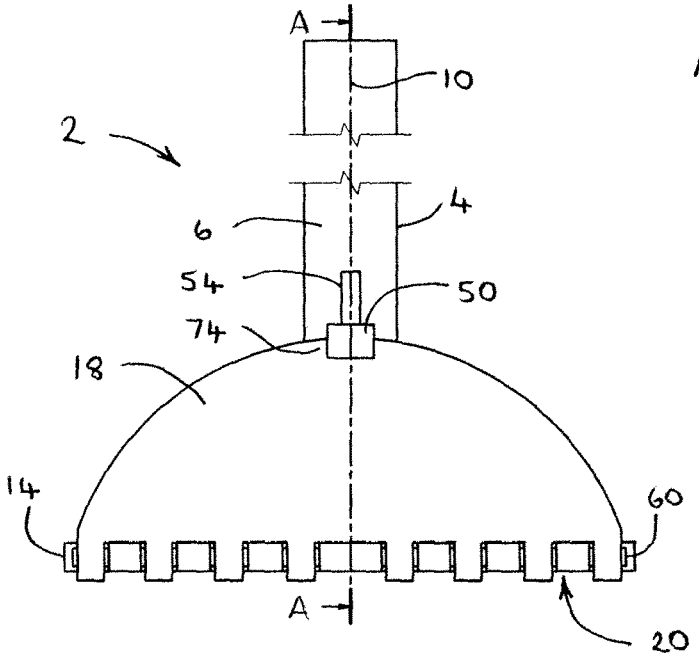
FIG. 1 is a schematic side view of a first embodiment of a stabiliser according to the invention in its non-deployed or stowed configuration.
Figure 2:
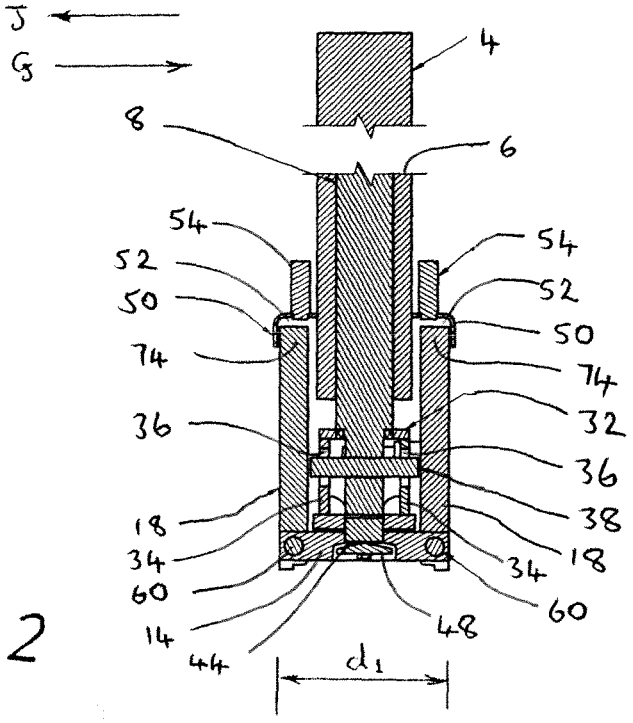
FIG. 2 is a schematic cross-section on the line A-A of the non-deployed stabiliser shown in FIG. 1.
Figure 3:
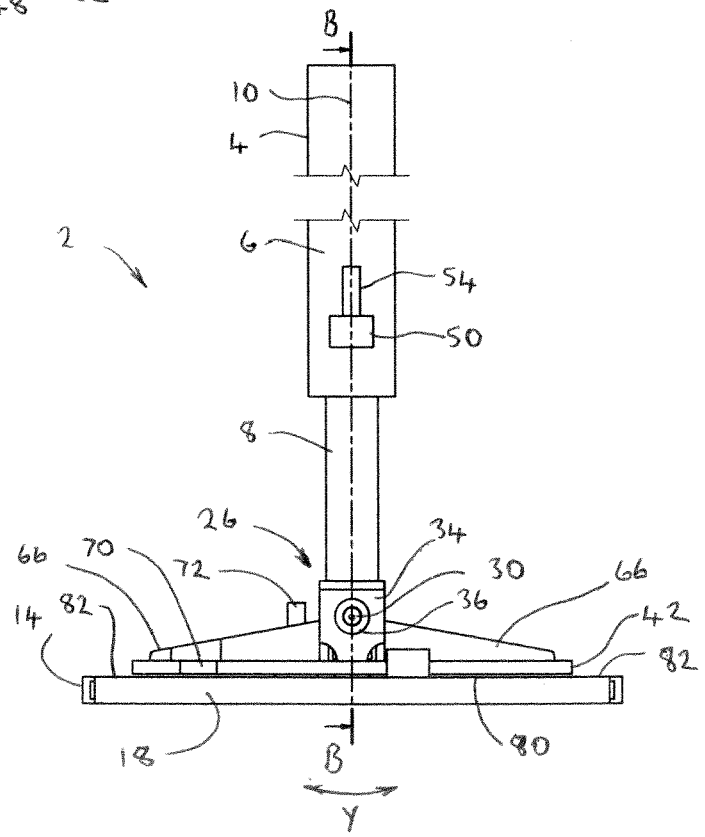
FIG. 3 is a schematic side view of the stabiliser shown in FIG. 1 in a partially deployed configuration.

Retention means are provided to hold the extension parts 18 in their stowed positions as shown in FIGS. 1 and 2. The retention means holds the extension parts 18 in their stowed positions when the extendible leg is retracted as shown in FIGS. 1 and 2. The retention means comprises a retention member 50 for each extension part 18. The retention means defines entrapment regions 52 which hold the extension parts 18 in their stowed positions as shown in FIGS. 1 and 2. A proximity sensor 54 is provided for each retention member 50 to provide a signal which can be used to confirm that the respective extension part 18 is in its fully stowed or non-deployed position. Signal(s) from such sensor(s) will also confirm that the leg 4 is fully retracted as shown in FIGS. 1 and 2.

The stabiliser also includes a locking mechanism 62 for locking the extension parts 18 in their lowered or deployed positions as shown in FIGS. 5, 6 and 7. The locking mechanism 62 comprises a locking member 64. A lowermost part of the locking member 64 is constituted by the base plate 42 which extends on opposite side of the foot mount 26 away from the foot mount 26. A reinforcing member 66 is fixed to an upper surface of the base plate 42 on each side of the foot mount 26 and bears against a respective side of the box 32. In the non-deployed or stowed configuration shown in FIG. 2, the locking member 64 extends along and overlies the primary part 14. A longitudinal axis 76 of the locking member 64 is parallel to a longitudinal axis 78 of the primary part 14. In the fully deployed configuration, the longitudinal axis 76 of the locking member 64 is positioned perpendicularly to the longitudinal axis 78 of the primary part 14 and the locking member 64 overlies both extension parts 18, as shown in FIG. 5. Rotation of the foot 12 relative to the locking member 64 by less than 90° may be sufficient to ensure that the extension parts 18 are held in their lowered positions, shown for example in FIG. 5. In both configurations an underside 80 of the baseplate 42 overlies and engages the foot 12. In the fully deployed configuration, shown in FIG. 5, a part of the underside 80 of the locking member 64 overlies and engages upper surfaces 82 of each of the extension parts 18.

Each extension part 18 is provided with a stop member 68, which engages a complementary stop recess 70 in the locking member 62. Engagement of the stop members 68 and the stop recesses 70 limits rotation of the foot 12 relative to the leg 4. One rather than two stop members 68 may be provided and the or each stop member 68 may simply abut the locking member 64 rather than be accommodated in a stop recess 70 thereof.

A proximity sensor 72 is provided to sense when the required rotation of the foot 12 relative to the locking member 64 has occurred. Such a proximity sensor 72 can conveniently be connected to or positioned closely adjacent to one stop member 68 as shown in FIG. 5. Alternatively, the proximity sensor may be provided on the locking member 64 and be arranged to sense the proximity of one of the stop members 68. Such positioning of the proximity sensor 72 would facilitate the transfer of signals between the proximity sensor and a central control system of the item of plant to which the stabiliser 2 is connected.

An operating cycle of the stabiliser shown in FIGS. 1 to 8 is described below.

When an item of plant, to which the stabiliser 2 is connected, reaches its working destination, the stabiliser will be displaced (by means not shown) in direction G, shown in FIG. 2, so as to become more spaced from a main body of the item of plant in order to increase the stabilisation provided by the stabiliser. An outermost portion 74 of each extension part 18 is retained in the entrapment region 52 of one of the retention members 50 thereby holding it in the non-deployed or stowed configuration shown in FIG. 2. The ram 8 will then be extended from the cylinder 6 in the direction H resulting in the stabiliser moving from the stowed configuration shown in FIG. 2 to the partially deployed configuration shown in FIG. 4. Initial movement of the ram 8 in this direction H will disengage the outermost portion 74 of each extension part 18 from the respective retention member 50 so that each extension part 18 will fall into the deployed or lowered position shown in FIG. 4 in which its sole portion 24 is aligned with the sole portion 22 of the primary part 14. When the extension parts 18 fall to this position a longitudinal axis 76 of the locking member 64 is aligned with a longitudinal axis 78 of the primary part 14.

The operator then grasps the foot 12 and rotates it in the direction I shown in FIG. 6 until each stop member 68 engages its complementary stop recess 70 in the locking member 64. When this has occurred, the stabiliser is in its fully deployed configuration as shown in FIGS. 5, 6 and 7. In the case of the first embodiment, the required rotation is 90°. The required angle of rotation could however be other than 90°. When the stop members 68 fully engage the stop recesses 70 the proximity sensor 72 provides a signal to a control system (not shown) which enables the operator to extend the ram 8 further from the cylinder 6 until the sole 56 of the foot 12 comes into contact with a supporting surface 58.

In the fully deployed configuration, an underside 80 of the baseplate 42 engages upper surfaces 82 of the extension parts 18 thereby holding them in their lowered or deployed positions.

In the event of the support surface 58, on to which the foot is lowered, not being level, rotation of the foot about one or both of the rotation axes 28 and 30 occurs. Rotation of the foot 12 about the first rotation axis as shown in FIG. 8 is possible as a consequence of the pivot pin 38 being a loose fit in the apertures 36.

The procedure for stowing the stabiliser is generally a reverse of the deployment sequence described above. One difference however is that, as the final stage of retracting the ram 8 into the cylinder 6 occurs, the operator lifts the extension parts 18 up in order that their outermost portions 74 enter the entrapment regions 52 of the retention members 50. When this occurs the proximity sensors 54 on the retention members 50 send signals to the control system, enabling the system to retract the stabiliser in the direction J, shown in FIG. 2, back towards the main body of the item of plant. A further proximity sensor may be provided to sense when full retraction of the stabiliser in direction J has occurred. The control system may prohibit transit of the item of plant until all such stabilisers have been fully inwardly retracted.

A stabiliser 90 according to a second embodiment of the invention, shown in FIGS. 9 to 13, is described below. The construction and operation of the stabiliser 90 are the same as those of the stabiliser 2 according to the first embodiment, except for the differences described below.

Figure 11:
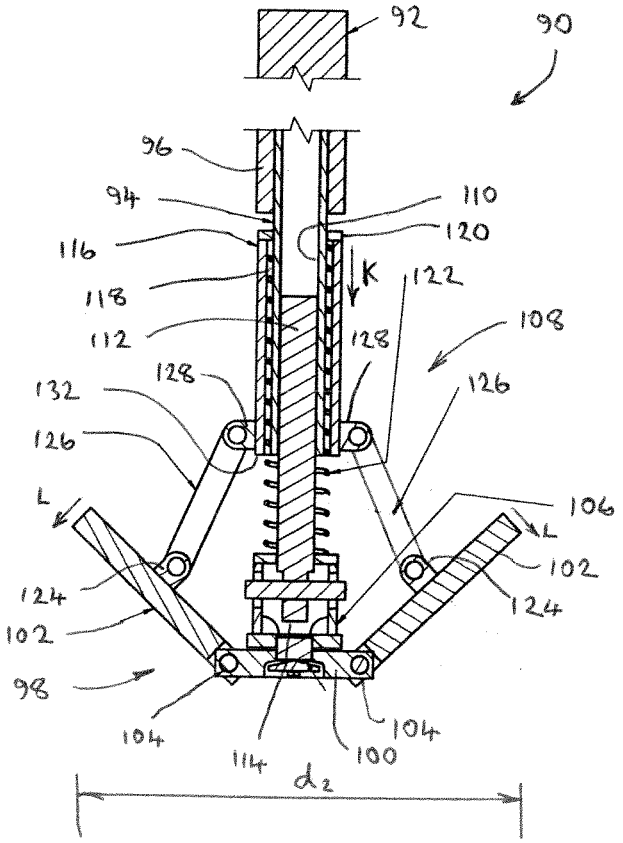
FIG. 11 is a schematic cross-section on the line C-C of the non-deployed stabiliser shown in FIG. 10.
Figure 12:
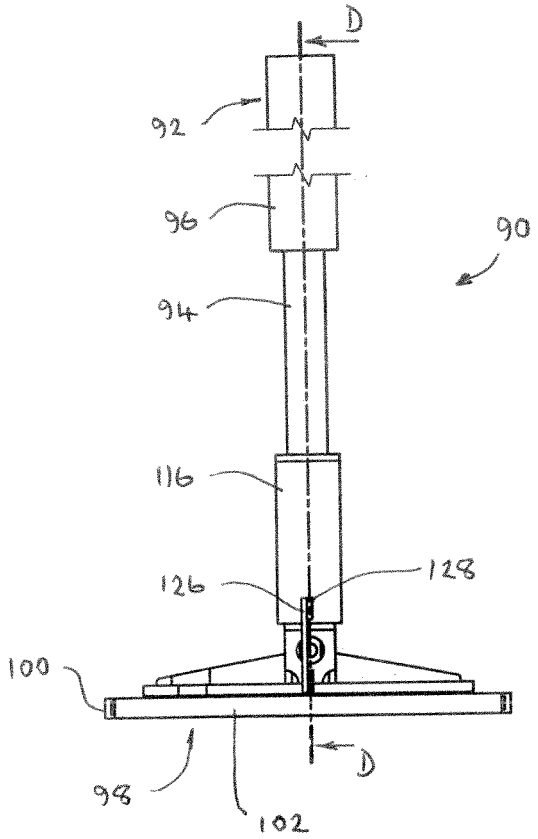
FIG. 12 is a schematic side view of the stabiliser shown in FIG. 9 in its fully deployed configuration.
Figure 13:
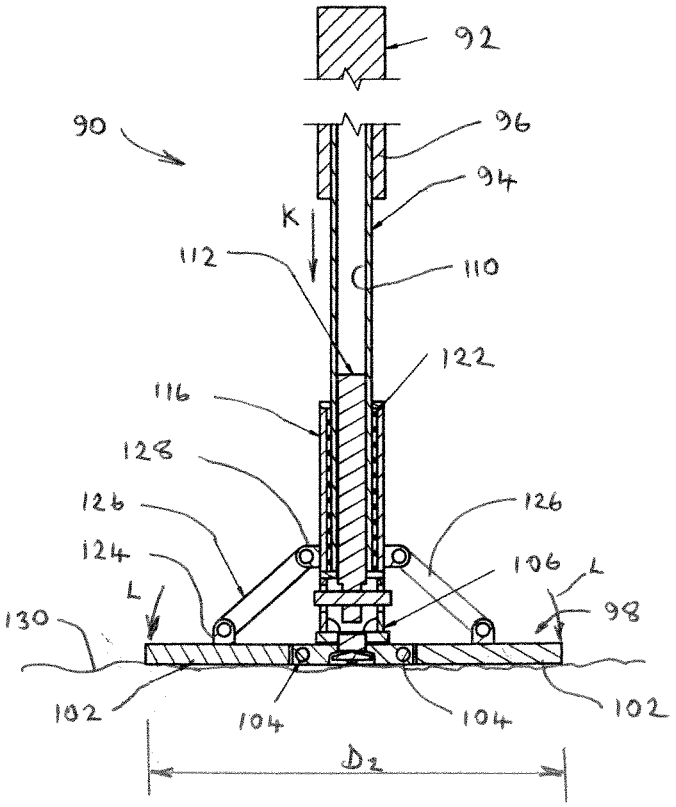
FIG. 13 is a schematic cross-section on the line D-D of the fully deployed stabiliser shown in FIG. 12.
Figure 17:
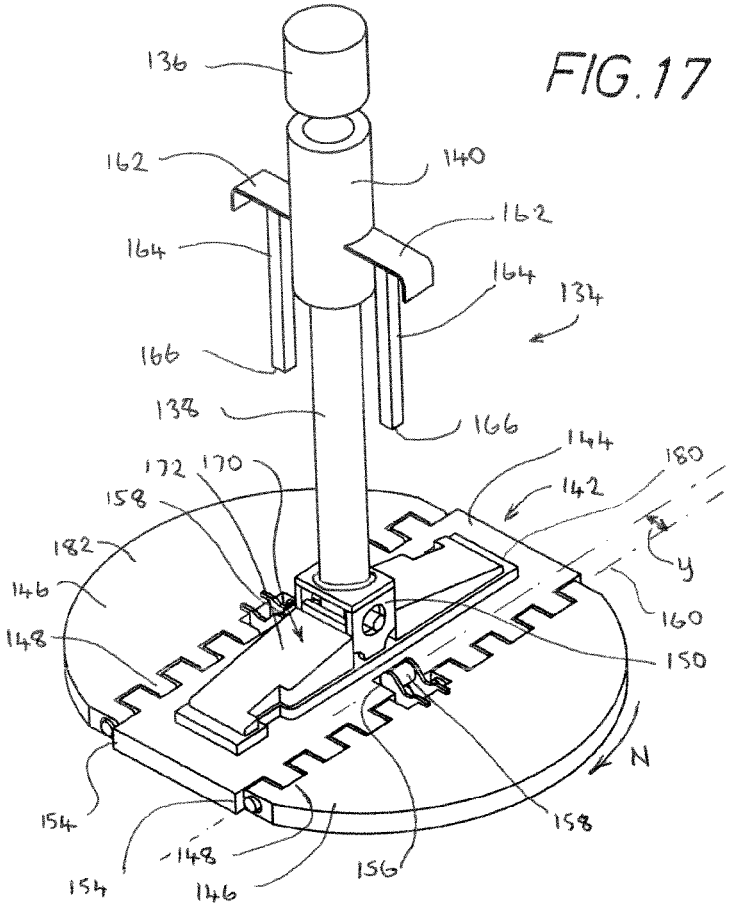
FIG. 17 is a schematic perspective view of the stabiliser shown in FIG. 14 in its partially deployed configuration.
Figure 18:
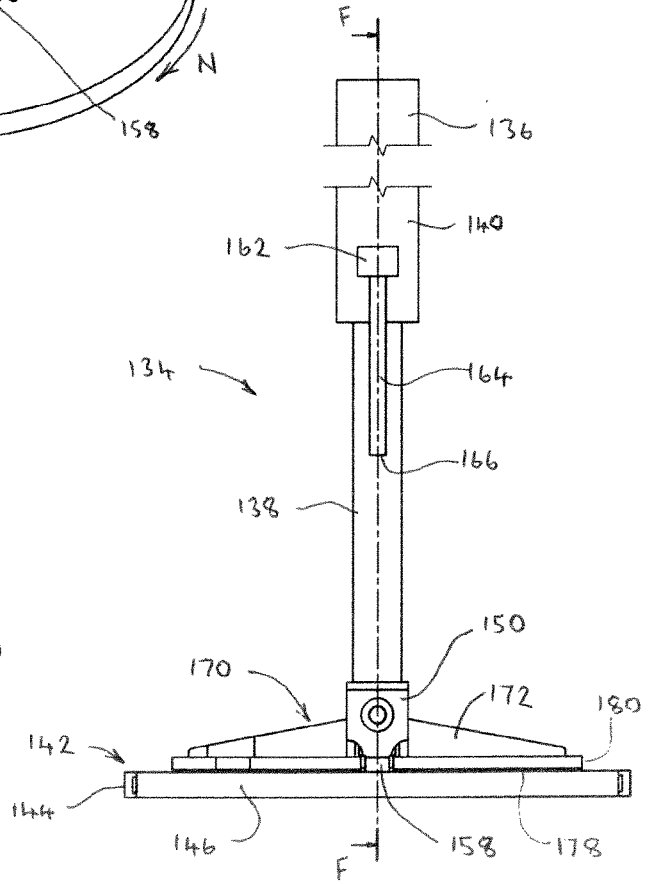
FIG. 18 is a schematic side view of the stabiliser shown in FIG. 17 in its partially deployed configuration.

The stabiliser 90 includes an extendible leg 92 including a cylinder 96 and a ram 94 which is extendible and retractable relative to the cylinder 96. The stabiliser 90 also includes a foot 98 with a primary part 100, with extension parts 102 connected to opposed sides thereof by hinges 104. The foot 98 is connected to the ram 94 by a foot mount 106. While the foot mount 106 shown in FIG. 11 would enable the foot 98 to be rotated relative to the extendible leg 92, such rotation is not necessary in this embodiment because holding of the extension parts 102 in their lowered positions, as shown in FIGS. 12 and 13, is effected by a deployment mechanism or locking mechanism 108 which will be described in detail below.

Figure 10:
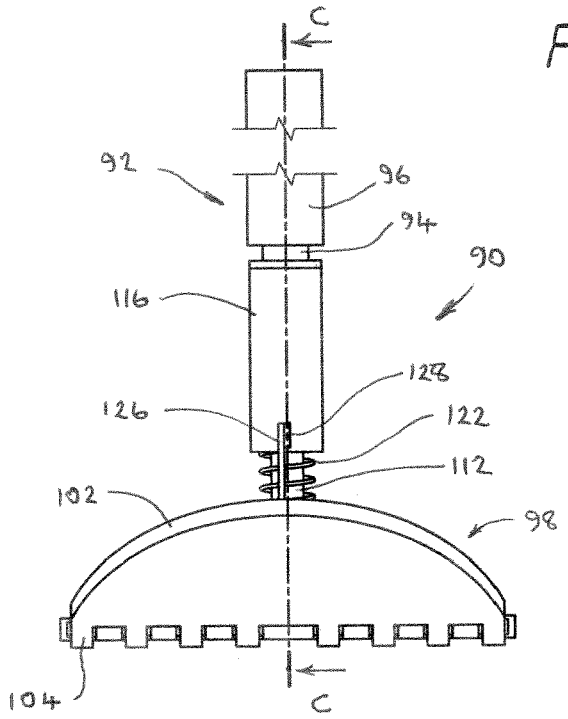
FIG. 10 is a schematic side view of the stabiliser shown in FIG. 9 in its non-deployed or stowed configuration.

The ram 94 is hollow and has a bore 110 in which a foot support 112 is slidably received. The foot support 112 is displaceable between an extended position shown in FIGS. 10 and 11 and a retracted position shown in FIGS. 12 and 13. A distal end 114 of the foot support 112 is connected to the foot mount 106 in the same way that the ram 8 and the foot mount 26 of the first embodiment are connected. A sleeve 116 surrounds the ram 94 and an annular space 118 exists between the sleeve 116 and the ram 94. The sleeve is connected to the ram by a sleeve end plate 120. A compression spring 122 is disposed around the foot support 112. The spring 122 bears against the sleeve end plate 120 and the foot mount 106 urging them away from each other. In the extended position of the foot support 112 an upper portion of the spring 122 is positioned in the annular space between the sleeve 116 and the ram 94. The spring 122 accordingly urges the foot support 112 outwardly of the ram 94 towards the configuration shown in FIGS. 10 and 11. Each extension part 102 has an extension lug 124 on an upper surface to which a link 126 is pivotably connected. An opposite end of each link 126 is pivotably connected to a respective sleeve lug 128 which extends outwardly from the sleeve 116. The links 126 are dimensioned and the lugs 124 and 128 are positioned such that extension of the foot support 112 from the ram 94 results in the links 126 drawing the extension parts 102 into their non-deployed or retracted positions as shown in FIGS. 10 and 11. For this reason, retention members 50 provided in the first embodiment are not required.

Parts of the operating cycle of the second embodiment, shown in FIGS. 10 to 13, which differ from the operating cycle of the first embodiment are described below.

As the ram 94 is extended from the cylinder 96 in the direction K the foot 98 comes into contact with a support surface 130. Continued extension of the ram 94 results in the spring 122 becoming compressed and the foot support 112 sliding further into the bore 110 in the ram 94. As this occurs, a lowermost end 132 of the ram 94 approaches the foot mount 106. Since the links 126 are connected to the ram 94 by means of the sleeve 116 and the sleeve lugs 128, this continued downward displacement of the ram 94 places the links 126 in compression thereby rotating the extension parts 102 in the directions L until they contact the support surface 130. The stabiliser 90 is accordingly moved into and held in its fully deployed configuration by downward movement of the ram 94. No rotation of the foot 98 relative to the extendible leg 92, or any other separate locking action is necessary in order to ensure that the extension parts 102 are held in their lowered or deployed positions. In the fully deployed configuration, shown in FIGS. 12 and 13, the spring 122 is compressed and accommodated in the space 118.

The procedure for stowing the stabiliser 90 is generally a reverse of the deployment sequence described above. Initial retraction of the ram 94 into the cylinder 96 will result in resiling of the spring 122. As the spring extends, the foot support 112 is urged outwardly of the ram 94 towards the position shown in FIG. 11. As this occurs, the links 126 draw the extension parts 102 upwardly to the positions shown in FIG. 11. Each link 126 constitutes a retention means for holding a respective extension part 102 in its non-deployed position as shown in FIGS. 10 and 11. Accordingly, no operator intervention is necessary to fold the extension parts 102 upwardly in order that they can be engaged by a retention member. Still further retraction of the ram 94 into the cylinder will result in the foot 98 being lifted clear of the support surface 130.

A stabiliser 134 according to a third embodiment of the invention, shown in FIGS. 14 to 20, is described below. The construction and operation of the stabiliser 134 are the same as those of the stabiliser 2 according to the first embodiment, except for the differences described below.

The stabiliser 134 includes an extendible leg 136 including a ram 138 and a cylinder 140. The stabiliser also includes a foot 142 with a primary part 144, with extension parts 146 connected to opposed sides 154 thereof by hinges 148. The foot 142 is connected to the ram 138 by a foot mount 150. The construction and interaction between the ram 138, the foot mount 150 and the foot 142 are the same as those for the corresponding parts of the first embodiment. The stabiliser 134 also includes a locking mechanism 170 including a locking member 172 which has the same construction and operation as the locking mechanism of the first embodiment.

With respect to the retention means for holding the extension parts 146 in their non-deployed or stowed positions, as shown in FIGS. 14, 15 and 16, instead of the stabiliser 134 including the retention members 50 of the first embodiment, it includes alternative retention means 152 described below.

Each side 154 of the primary part 144 includes a recess 156 into which an abutment extension 158 of the adjacent extension part 146 projects. Each abutment extension 158 is spaced inwardly of the associated hinge axis 160 by a distance y. Above each abutment extension 158 a bracket 162 extends laterally outwardly from the cylinder 140 from the underside of which a retention member or retention rod 164 projects towards the abutment extension 158. Each retention rod 164 is positioned such that, when the ram 138 is retracted fully into the cylinder 140, as shown in FIGS. 14, 15 and 16, a distal end 166 of each actuator rod 164 displaces the associated abutment extension 158 downwardly relative to the primary part 144. Due to the fact that the point of contact between the distal end 166 of each retention rod 164 and its associated abutment extension 158 is spaced inwardly from the associated hinge axis 160 by the distance y, the associated extension part 146 is held in a non-deployed or stowed position as shown in FIGS. 14, 15 and 16.

Figure 19:
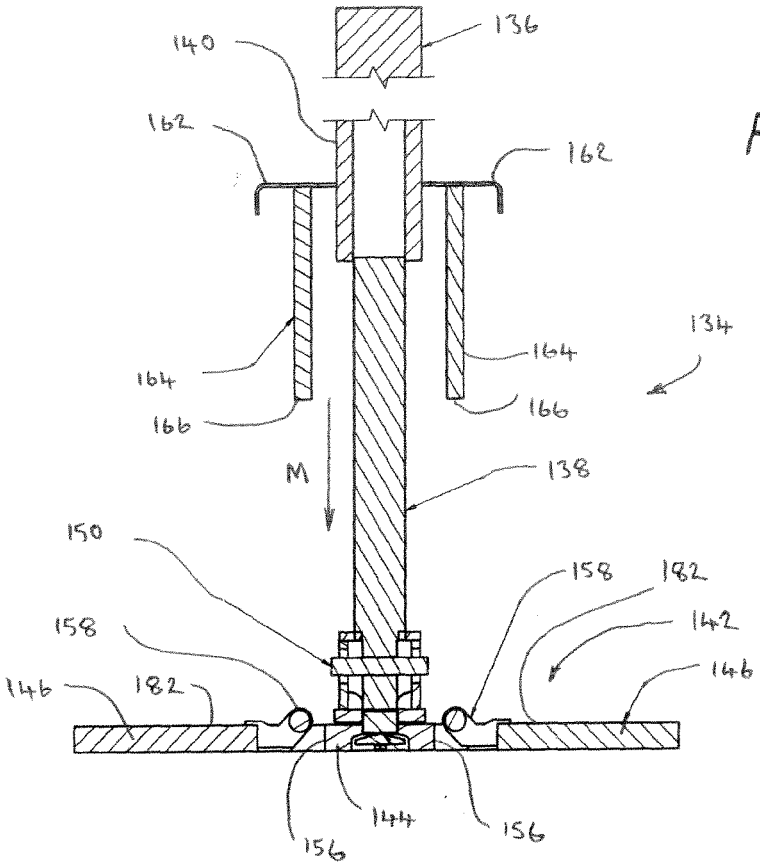
FIG. 19 is a schematic cross-section on the line F-F of the partially deployed stabiliser shown in FIG. 18.
Figure 20:
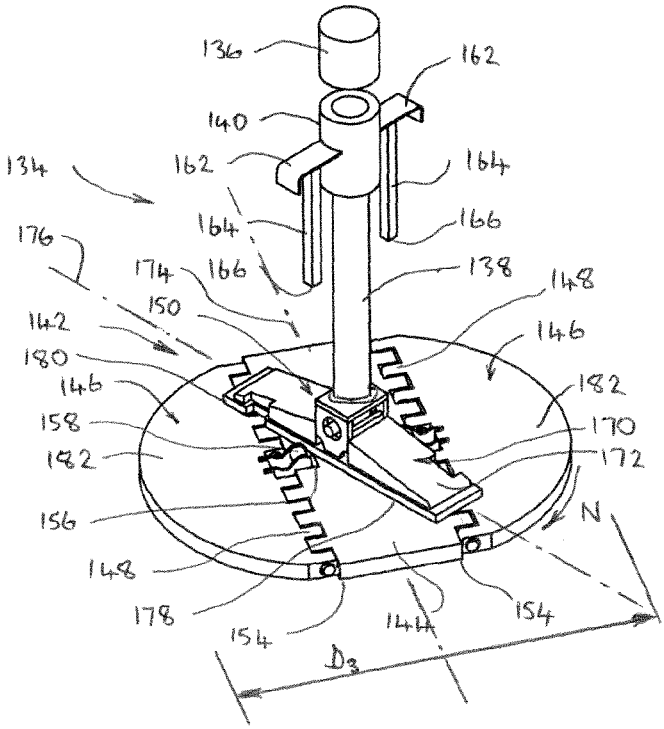
FIG. 20 is a schematic perspective view of the stabiliser shown in FIG. 14 in its fully deployed configuration.

When the stabiliser 134 is to be deployed, after displacement of the stabiliser as a whole away from the item of plant, as described above with reference to the first embodiment, the ram 138 is extended downwardly out of the cylinder 140 in the direction M as shown in FIG. 19. Initial downward displacement of the ram 138 moves the abutment extensions 158 out of contact with the retention rods 164 thereby allowing the extension parts 146 to fall under the influence of gravity to their lowered or deployed positions relative to the primary part 144 shown in FIG. 19. Continued extension of the ram 138, to the position shown in FIGS. 17, 18 and 19, will bring the foot 142 close to the intended support surface. The operator then rotates the foot 142 relative to the locking member 172 in the direction N, such that a longitudinal axis 174 of the primary part 144 is disposed at an angle relative to a longitudinal axis 176 of the locking member 172 as shown in FIG. 20. In the fully deployed configuration, shown in FIG. 20, an underside 178 of a baseplate 180 of the locking mechanism 170 engages upper surfaces 182 of the extension parts 146 thereby locking the extension parts 146 in their fully deployed positions.

The stabiliser 134 will include one or more stop members and proximity sensors, for the same purpose as those forming part of the first embodiment, which have not all been shown in FIGS. 14 to 20.

The procedure for stowing the stabiliser 134 is generally a reverse of the deployment sequence described above.

For the first embodiment, the width of the foot 12, perpendicular to the longitudinal axis 78 of the primary part 14 increases from $d_1$ to $D_1$ as the stabiliser is converted from its stowed configuration, shown in FIG. 2, to its fully deployed configuration, shown in FIG. 5.

For the second embodiment, the width of the foot 98, perpendicular to the longitudinal axis 101 of the primary part 100 increases from $d_2$ to $D_2$ as the stabiliser is converted from its stowed configuration, shown in FIG. 11, to its fully deployed configuration, shown in FIG. 13.

For the third embodiment, the width of the foot 142, perpendicular to a longitudinal axis 174 of the primary part 144, increases from $d_3$ to $D_3$ as the stabiliser is converted from its stowed configuration, shown in FIG. 16, to its fully deployed configuration, shown in FIG. 20.

The invention claimed is:

1. A mobile plant stabiliser including an extendible leg and a load distributing foot connected to the extendible leg, wherein the foot includes a primary part and an extension part connected to the primary part by a hinge enabling the extension part to rotate relative to the primary part to and from a deployed position in which the extension part extends laterally outwardly from the primary part, the stabiliser further including a locking mechanism for locking the or each extension part in its deployed position, and wherein the locking mechanism includes a locking member extending radially outwardly from the leg, the foot being rotatable relative to the locking member about a longitudinal axis of the leg such that the or each extension part becomes engaged by the locking member to lock it in its deployed position.

2. The stabiliser of claim 1 wherein, in its deployed position, a downwardly facing sole portion of the extension part forms an extension of a downwardly facing sole portion of the primary part.

3. The stabiliser of claim 1 wherein the foot includes two extension parts arranged on opposite sides of the primary part and each connected to the primary part by a respective hinge.

4. The stabiliser of claim 1 including a retention mechanism that holds the or each extension part in a non-deployed position.

5. The stabiliser of claim 4 wherein the retention mechanism is configured to hold the or each extension part in its non-deployed position when the leg is retracted.

6. The stabiliser of claim 4 wherein the retention mechanism includes at least one retention member and wherein the or each extension part is engageable with one said retention member when the leg is in a retracted state to hold the extension part in its non-deployed position.

7. The stabiliser of claim 6 wherein the or each extension part includes an abutment arranged such that retraction of the leg brings the abutment into contact with one said retention member thereby urging the extension part into its non-deployed position.

8. The stabiliser of claim 4 wherein the retention mechanism includes retention members which define entrapment regions configured to hold the extension parts in their stowed positions when the leg is in a retracted state.

9. The stabiliser of claim 8 configured such that extension of the leg disengages the or each extension part from its associated retention member.

10. The stabiliser of claim 9 configured such that initial extension of the leg disengages an outermost portion of each extension part from the respective retention member.

11. The stabiliser of claim 1 including at least one proximity sensor for sensing a predetermined stage in a deployment sequence of the stabiliser.

12. The stabiliser of claim 11 including a sensor provided to sense when a required rotation of the foot relative to the locking member has occurred.

13. The stabiliser of claim 11 including a proximity sensor arranged to provide a signal to confirm that a respective extension part is in a fully stowed position.

14. The stabiliser of claim 1 further including a stop member which limits rotation of the foot relative to the leg.

15. The stabiliser of claim 1 configured such that rotation of the foot is possible so that a sole of the foot is not perpendicular to the longitudinal or extension axis of the leg.

* * * * *